United States Patent [19]

Murday

[11] 4,143,918

[45] Mar. 13, 1979

[54] MINING CONVEYOR ASSEMBLIES WITH CONTROL BOXES ON FENCE

[75] Inventor: William Murday, Kimberley, England

[73] Assignee: Winster Mining Limited, England

[21] Appl. No.: 655,204

[22] Filed: Feb. 4, 1976

[51] Int. Cl.[2] ..... E21C 35/12

[52] U.S. Cl. ..... 299/43; 299/34

[58] Field of Search ..... 299/1, 32, 34, 43–48; 61/45 D; 191/12 R

[56] References Cited

U.S. PATENT DOCUMENTS

| | | | |
|---|---|---|---|
| 3,721,378 | 3/1973 | Hughes et al. | 299/43 X |
| 3,826,535 | 7/1974 | Fujimori et al. | 299/43 X |
| 3,861,751 | 1/1975 | Erwien | 299/43 |
| 3,997,039 | 12/1976 | Hubbard et al. | 299/43 X |

FOREIGN PATENT DOCUMENTS

| | | | |
|---|---|---|---|
| 1050436 | 12/1966 | United Kingdom | 299/43 |
| 1410906 | 10/1975 | United Kingdom | 299/43 |
| 1441913 | 7/1976 | United Kingdom | 299/43 |

*Primary Examiner*—Ernest R. Purser

*Attorney, Agent, or Firm*—Ostrolenk, Faber, Gerb & Soffen

[57] ABSTRACT

A mining conveyor assembly of the kind comprising a conveyor which, in the use of the assembly, extends alongside a mine face. The conveyor comprises an elongate wall connected to and upstanding from the conveyor on the goaf side thereof, and a fence structure secured to the assembly in spaced relation to the wall member to provide a trough, in which the cable or cables supplying services to a mining machine, which travels along a trackway afforded by the conveyor assembly, is received as the machine traverses backwardly and forwardly along the trackway.

The fence structure is yieldable to externally applied forces, preferably both in a direction laterally of the fence structure, and also in a direction extending longitudinally of the fence structure. In this manner, tendency of the cable or cables to become damaged, during operation, may be minimized.

Alternatively, or in addition, control units of the kind whereby personnel engaged in the mining operation may transmit a signal to a main control station are located in chambers, provided at spaced intervals along the length of the fence structure.

7 Claims, 5 Drawing Figures

MINING CONVEYOR ASSEMBLIES WITH CONTROL BOXES ON FENCE

BACKGROUND OF THE INVENTION

This invention relates to mining conveyor assemblies, and has been developed primarily in relation to the requirements which arise in underground mining wherein the main appartus is a machine for cutting or otherwise extracting the material to be mined, for example coal, travels along a face presented by said materials to such apparatus, and one or more cables are attached to this machine to convey services thereto.

The expression "cable" used herein is intended to denote any elongated flexible member primarily for conveying electric current, but includes also a flexible member for conveying fluid under pressure such as a flexible hose.

In mining, by the use of apparatus as above described, and in particular in coal mining by the method known as long wall coal mining, a conveyor assembly extends along and adjacent to the face, and the machine by which the coal or other mineral is extracted travels along a trackway afforded by the conveyor assembly with the cable or cables extending from such machine and lying generally alongside the conveyor assembly on the goaf side remote from the face. It is common practice to provide a carrier means on the conveyor assembly at the goaf side within which the cable or cables lie for the purpose of preventing the cable or cables taking up runs of random configuration which would interfere with the proper operation of the machine, become snagged around adjacent apparatus such as roof supports, and generally be exposed to damage resulting from such run or configuration.

In addition, it is an operational requirement that at each of a plurality of stations spaced apart along the face, the personnel engaged in the mining operation shall be able to transmit a signal to a main control station normally situated at one end of the face for the purpose of enabling an operator thereat to stop or start the conveyor assembly. It is a further requirement that the personnel shall be able to stop the operation of the conveyor assembly by operation of a control unit at each of the stations along the control face (independently of the facilities provided at each of these stations for signalling the operator at the main control station).

Control units of the kind to give effect to these requirements (herein referred to as "control units of the kind specified") normally include a signalling switch (usually a push-button operated switch spring-loaded to an off position) and a further switch, normally termed a lock-out switch, which can be moved from its normal unoperated position to an operated position in which it is held by retaining means independently of continued pressure or force exerted on the switch by the person operating it. The signalling switch conveys a signal to the operator at the main station to stop or start the conveyor (according to the nature of the signal given), and the lock-out switch produces stopping of the conveyor independently of any action on the part of the operator at the main station. Further, the control unit is usually provided with indicator means in the form of a lamp which is normally unenergised but which is energised and hence illuminated whenever the lock-out switch is moved from its unoperated to its operated position.

One form of conveyor assembly at present in service comprises a fence structure defining a trough open at its upper side, said trough providing the carrier means of the conveyor assembly. The inner side wall of this trough is formed by the upstanding goaf or spill plate of the conveyor assembly while its outer side may be formed by a series of longitudinally successive plates each having a length corresponding to a length of a section of the conveyor. The latter is normally formed of sections articulately connected to each other to allow the longitudinally successive sections of the conveyor assembly to be advanced one after another towards the face as the coal or mineral is extracted therefrom.

Each longitudinal plate is connected to the spill plate of the conveyor assembly by a base section of the trough, so that, in effect, the trough consists of a number of longitudinally successive sections.

At adjacent ends the outer side plates of the trough are in some cases connected to each other by flexible straps which admit of snakewise advancement of the conveyor assembly.

One of the disadvantages of this arrangement is, however, that despite the strip successive sections of the trough do afford gaps between adjacent ends of the outer side plates and the cables may become trapped in these and subject to damage.

The trough also frequently becomes filled by an accumulation of debris and coal, which interferes with proper movement of the cable or cables which it carries.

Further, the outer side plate of each individual trough section is rigidly connected to the spill plate of the conveyor assembly and thus cannot deflect in a vertical plane. It is sometimes the case that a portion of a cable will become trapped between the other side of the outer plate and some adjacent piece of apparatus such as a roof support, and the unyielding character of the outer side plate then leads to damage of the cable.

In yet another construction at present in service, the carrier means comprises a series of U-shaped brackets spanned at their upper ends by flaps which can be opened and closed to admit of entry and removal of the cable. The disadvantage of this arrangement is that again the brackets are rigid and consequently the cable can become trapped between the bracket and a roof support advancing towards this with resultant damage to the cable.

Furthermore, it is necessary for an operator to lift the flaps to allow the cable to pass into and out of the aperture afforded by the bracket each time the cutting or extracting machine passes.

Additionally, whilst the cable or cables associated with the mining machine are "movable" to the extent that loop-like runs of these cables lie in the trough afforded by the cable carrier means with such loops occupying a proportion of the length of the trough dependent upon the position of the mining machine, there are also other cables (herein called static cables) which form part of the control and/or indicator system for controlling operation of the main apparatus (in this case the conveyor). These static cables normally lie on the goaf side of the trough in which the "movable" cables are accommodated and certain of the static cables, as appropriate, are connected to the control units which are situated at stations spaced apart along the face as previously mentioned.

In addition, from the point of view of mounting the control units of the kind specified which form part of the control and/or indicator system associated with the conveyor at a position at which the personnel present in the mine working can have rapid and convenient access to these control units the most suitable place for mounting these control units is on the outer wall of the conveyor.

However, this creates a number of additional problems certain of which are concerned with the "movable" and "static" cables and certain of which are concerned with the approach of mine roof supports to the conveyor.

If the control units are mounted at the inner side of the outer wall of the trough so as to lie within the trough itself, they obstruct movement of the movable "cables" in the trough as the mining machine travels along the conveyor. If the units are mounted at the outer side of the outer wall of the trough they do cause some obstruction to the installation of the static cables supported in a channel at the outer side of this wall of the trough by virtue of overhanging the mouth of this channel, but more importantly the control units themselves are then necessarily placed in close proximity to the forward ends of movable roof supports which have to be brought up close to the conveyor so that the roof supporting superstructure of these supports can extend over the conveyor as close as possible to the face of the mine working. In this respect it is a requirement that between the face side of the conveyor on the face of the mine working a "prop-free front" should be maintained to allow unobstructed progress of the mining machine and this in turn requires that the foremost props of each support could be brought close as possible to the outer or goaf side of the conveyor.

Even if the props are arrested at a position in which they are short of the control units, the space between the control units and the props is comparatively small making it difficult for mining personnel to move along the conveyor between this and the roof supports, but also there is a considerable risk that the props will come into contact with the control units especially where the floor of the mine working presents a slope either laterally along the coal face or towards the coal face.

SUMMARY OF THE INVENTION

This invention provides, in a mining conveyor assembly comprising:

(a) a conveyor which in the use of the assembly extends alongside a mine face, (b) an elongate wall connected to and upstanding from the conveyor, and (c) a fence structure secured in spaced relation to the wall member to provide a trough, the improvement wherein the fence structure is yieldable to externally applied forces in a direction laterally of the fence structure.

Thus, should a loop of cable be lowered on the outside of the fence structure, if, on subsequent advance of the mine support system, the cable becomes trapped between the outside of the fence structure and the roof support system, the cable is less likely to be damaged, since the fence structure may yield to the lateral forces applied by the roof support system.

Advantageously, the fence structure is resiliently-deformable under such laterally applied forces. In this manner, on subsequent advance of the conveyor assembly forwardly of the roof support system, the fence structure will be restored to its original position.

Conveniently, the fence structure is of openwork form. In this manner, should debris, such as coal or dirt, fall into the trough, it may fall from the trough between the elements of the openwork fence structure.

Preferably, the fence structure is yieldable to externally applied forces in a direction longitudinally of the fence structure. Conveniently, the fence structure is resiliently deformable to relatively small longitudinal forces, whereby on trapping of a loop of the cable between the outside of the fence structure and, e.g. the roof support system, the fence structure may yield in a direction longitudinally thereof. However, preferably, the fence structure is constructed and arranged in a manner such that, under large longitudinally applied forces, the various elements of the fence structure will separate. In this manner, should a loop of cable become snagged around a fence structure element, upon advance of the machine served by the cable, the fence structure will be torn down, rather than the cable being separated.

This invention also provides, in a mining conveyor assembly comprising a trackway upon which a cutting machine may travel, and a fence structure secured in relation to and extending alongside the trackway on the side thereof remote from the face presented by the material being mined, the fence structure defining a trough adapted to receive flexible cables attached to the cutting machine and conveying services thereto as the machine traverses the face, the improvement wherein the fence structure is yieldable to externally applied forces to minimise the possibility of damage being caused to the cable during operation of the assembly.

This invention also provides, in a mining conveyor assembly comprising:

(a) a conveyor for travelling alongside a mine face, (b) an elongate wall member upstanding from the conveyor, and (c) a fence structure secured in spaced relation to the wall member to provide a trough, the improvement wherein the fence structure incorporates, at spaced intervals along the length thereof, a plurality of chambers, each containing or adapted to contain a control unit of the kind specified.

Preferably the fence structure comprises a plurality of longitudinally-spaced upright elements, preferably flexible, and a plurality of longitudinally-extending elements, conveniently also flexible, connected to and extending between the upright elements, the chambers being incorporated in the upright elements, preferably adjacent to the upper ends thereof.

Advantageously, the fence structure is resiliently deformable under laterally applied forces, and preferably also under small longitudinally upright forces: however, conveniently, the fence structure comprises elements which are secured together in a manner such that they will separate under large longitudinally-applied forces.

BRIEF DESCRIPTION OF THE DRAWINGS

The invention will now be described, by way of example, with reference to the accompanying drawings illustrating two preferred embodiments of this invention.

In the accompanying drawings.

DESCRIPTION OF THE PREFERRED EMBODIMENTS

Figure 2:
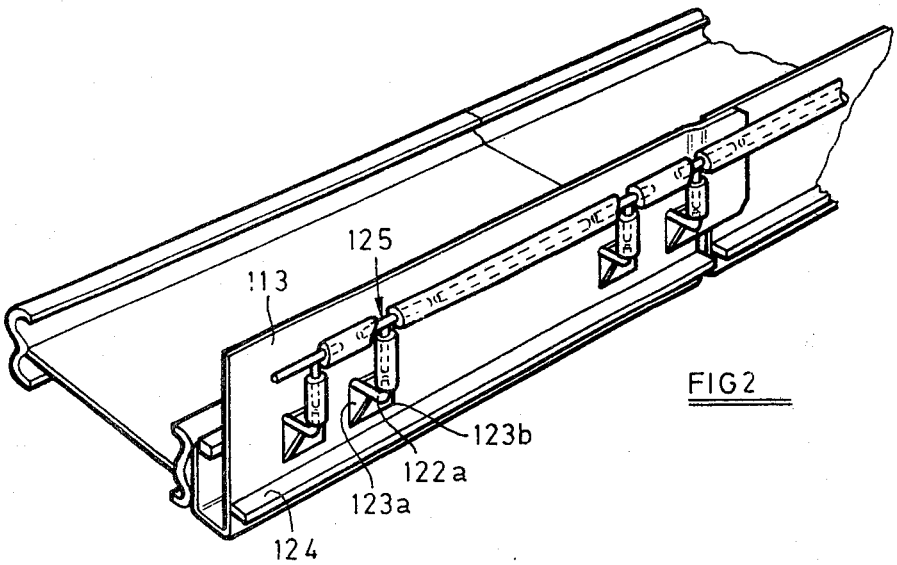
FIG. 2 is a view similar to that shown in FIG. 1, illustrating a modified form of the first embodiment.

The first embodiment of this invention is a conveyor assembly comprising a conveyor 10 of generally conventional construction (FIG. 1) and which includes a deck plate 11 bounded laterally by rails 12 providing a trackway along which a machine for cutting or otherwise extracting coal or other material from a long wall face is caused to travel.

At the side of the assembly remote from the long wall face the conveyor is provided with a spill plate 13 integrally connected at its lower end to a trough section portion 14 secured to the adjacent rail 12.

The conveyor is formed of a plurality of longitudinally successive sections which are articulately connected to each other at junctions illustrated diagrammatically by lines 15, and which admit of the conveyor being advanced in the direction of the arrow 16 towards the face section-by-section. As viewed in plan the conveyor is of shallow S or snake-like configuration during advancement.

It will be noted that the plates 13 are likewise formed in separate sections and end portions thereof are of cranked form to overlap with adjacent end portions 17 of the adjoining plate but are not attached to each other at this position in order to provide the necessary flexure to accommodate articulation of the conveyor sections.

The plates form one side wall of a trough in which cables, such as electric cables, or hoses, or both, conveying service supplies to the coal cutting or extracting machine, are accommodated during travel of the latter along the rails 12.

The outer side wall of the trough is formed in accordance with the present invention as a fence structure and is composed of a plurality of longitudinally spaced upright elements 18 connected to each other by longitudinally extending elements 19,20.

The elements 18 are constructed so as to be yieldable in relation to forces applied laterally of the fence structure, such as may be applied to the fence structure by the advancing roof support system. Thus, should any part of the cable be trapped between the outer side of the fence structure and such supports, the fence will yield in preference to damaging the cable. Specifically, the elements are constructed so as to be resiliently deformable to such laterally applied forces.

In addition, the elements 19,20 are constructed so as to be yieldable in relation to forces applied longitudinally of the fence structure. In particular, the fence structure is constructed so as to be resiliently deformable under relatively small longitudinal forces, such as may be applied should a loop of cable be trapped between the outside of the fence structure and the roof support system, upon advance of the main cutting apparatus and the drawing of the cable between the fence structure and the support system: however, the fence structure is constructed so as to be disruptable under relatively large longitudinal forces, such as may be applied should a loop of cable become snagged around a fence structure element. In this latter circumstance, upon advance of the main cutting apparatus, upon the drawing up of the cable, the fence structure will be torn down, rather than the cable being broken.

For these purposes each of the elements 18 comprises a length 21 of tubular rubber hose, preferably armoured, that is to say incorporating a sleeve of braided metallic material inbetween its inner and outer boundaries.

The upright elements 18 further comprise rod or bar elements 22 which are a tight fit in the interior of the lengths of hose 21 and are secured in any suitable manner as, for example, by welding to brackets 23 secured preferably detachably as, for example, by bolts (not shown) to a rail 24 extending along the goaf side of the spill plate 13.

The rail 24 is formed with a series of apertures 28 and thus the brackets 23 can be secured thereto at any desired position.

Figure 1:
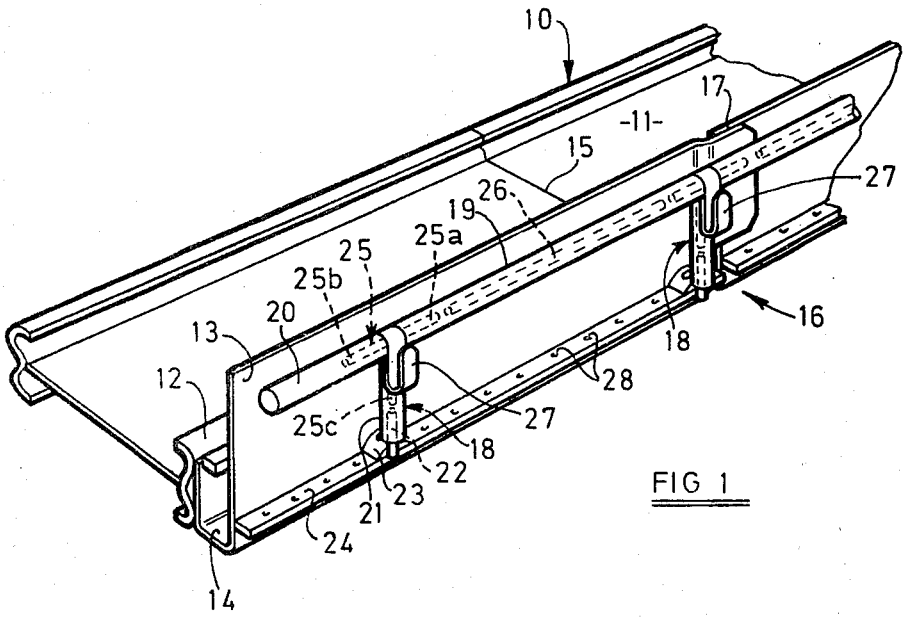
FIG. 1 is a perspective view illustrating a first embodiment of this invention.

As shown in FIG. 1, it is contemplated that a pair of brackets and upright elements will be secured to each conveyor section.

Reverting to the upright elements 18, these are connected to the longitudinally extending elements 19 and 20 at the upper ends of the elements 18 by T-shaped connecting elements 25 also composed of metal rod or bar, and hence relatively rigid, the downwardly projecting arm fitting tightly in the interior of the lengths of hose 21.

The horizontal elements 19 and 20 are also yieldable to forces applied laterally and longitudinally of the fence structure, being likewise composed of flexible armoured rubber hose. Typically the outside diameter of such hose may be approximately $1\frac{3}{4}$ inches. The horizontal arms of the T-shaped connecting elements fit tightly within the lengths 19 and 20 and may extend for any proportion of these lengths if desired. The lengths of hose 20 between the T-shaped connecting elements may contain lengths of rigid bar 26 to further stiffen the structure. Such stiffening is desirable in the situation where an operator uses the fence structure as a step to enable him to climb over the conveyor.

A typical arrangement is illustrated in broken lines which shows that arms **25*a* and 25*b* of the T-shaped connecting elements extend a short distance, for example 4 inches to 8 inches, within the interiors of the lengths of hose which form the horizontal elements 19 and 20, whereas the vertical arm 25*c* extends for nearly the whole length of the piece of hose 21 and may even abut the upper end of the rod-like element 22**.

The degree of longitudinal insertion or overlap between the rigid elements and the flexible elements of the fence structure can be varied, as required, to provide the required balance between rigidity and ability to yield elastically in relation to laterally applied forces.

It will also be evident that the horizontal elements 19 and 20 provide flexibility in a horizontal plane which likewise can be controlled by the extent of insertion or longitudinal overlap between the pieces of hose and the rigid elements.

Hooks 27 may be mounted on T-pieces 25 to provide supports for static cables, i.e. cables other than those serving apparatus which moves along the length of the conveyor. Such cables, which may be power supplies for stationary apparatus or part of a control system, are thus separated from the moving cables.

In the modified form of the first embodiment, illustrated in FIG. 2, parts corresponding to those already described are designated by like numerals of reference with the prefix 1, and the preceding description is to be deemed to apply.

In this construction the main difference is in the form of the lower rod-like elements 22 which are of L-shape as viewed in end elevation. The horizontal limbs 122*a* are welded to the upper ends of triangular gussets 123*a* of brackets 123 which are secured by means of plates 123*b* directly to the spill plate 113 instead of to the rail 124, thereby leaving the latter unobstructed over its entire length for attachment to the advancing rams of powered roof supports. In addition, as shown in FIG. 2, four upright elements are secured to each conveyor section.

It will be noted that the major part of the surface presented by the fence structure is non-metallic, e.g. the rubber hoses, and consequently this in itself provides a degree of cushioning with respect to any cables brought into forceable contact therewith.

No attention is required on the part of the operator since the cables can rise and fall freely from the open mouth of the trough defined between the fence structure and the spill plate.

Further, the fence structure is readily adaptable to different designs of conveyor and different lengths of conveyor section, in that the brackets 23 or 123 can be attached at any desired positions and at any desired spacings.

Although the fence structure described above is constructed from a number of separate parts, it would be within the scope of the invention to have the fence structure formed, for example, as a one-piece moulding of material of the required flexibility.

Figure 3:
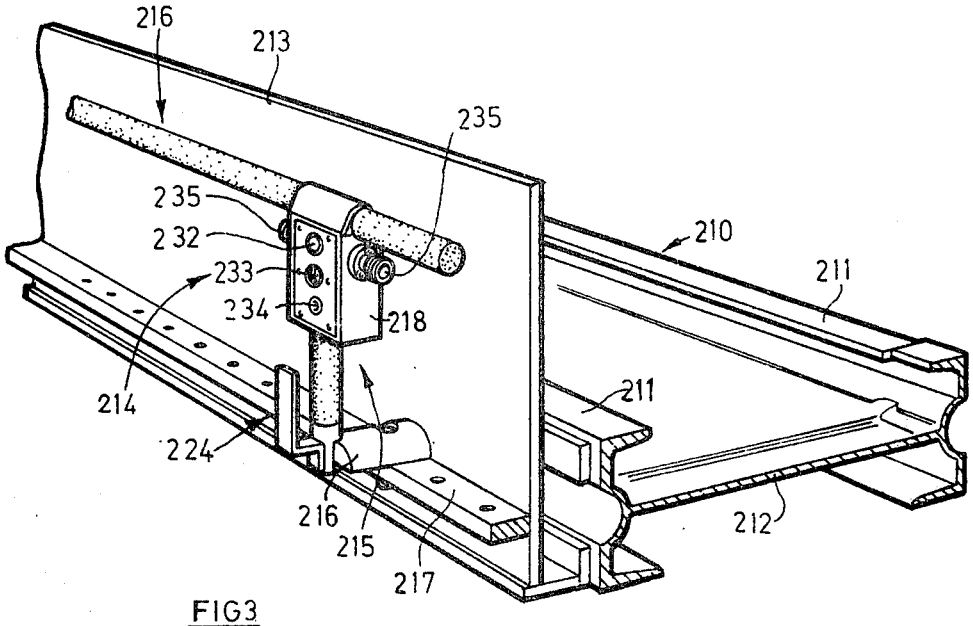
FIG. 3 is a perspective view showing a portion of the second embodiment of this invention.
Figure 5:
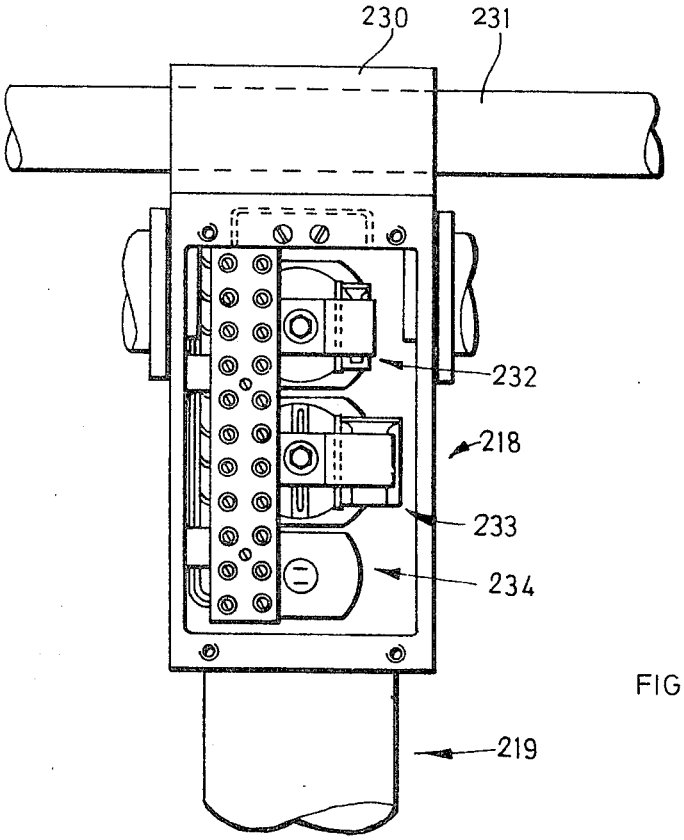
FIG. 5 is a fragmentary view in rear elevation of one of the chambers of the second embodiment, the rear cover plate thereof having been removed showing the location of control and/or indicator devices forming component parts of the control units.
Figure 4:
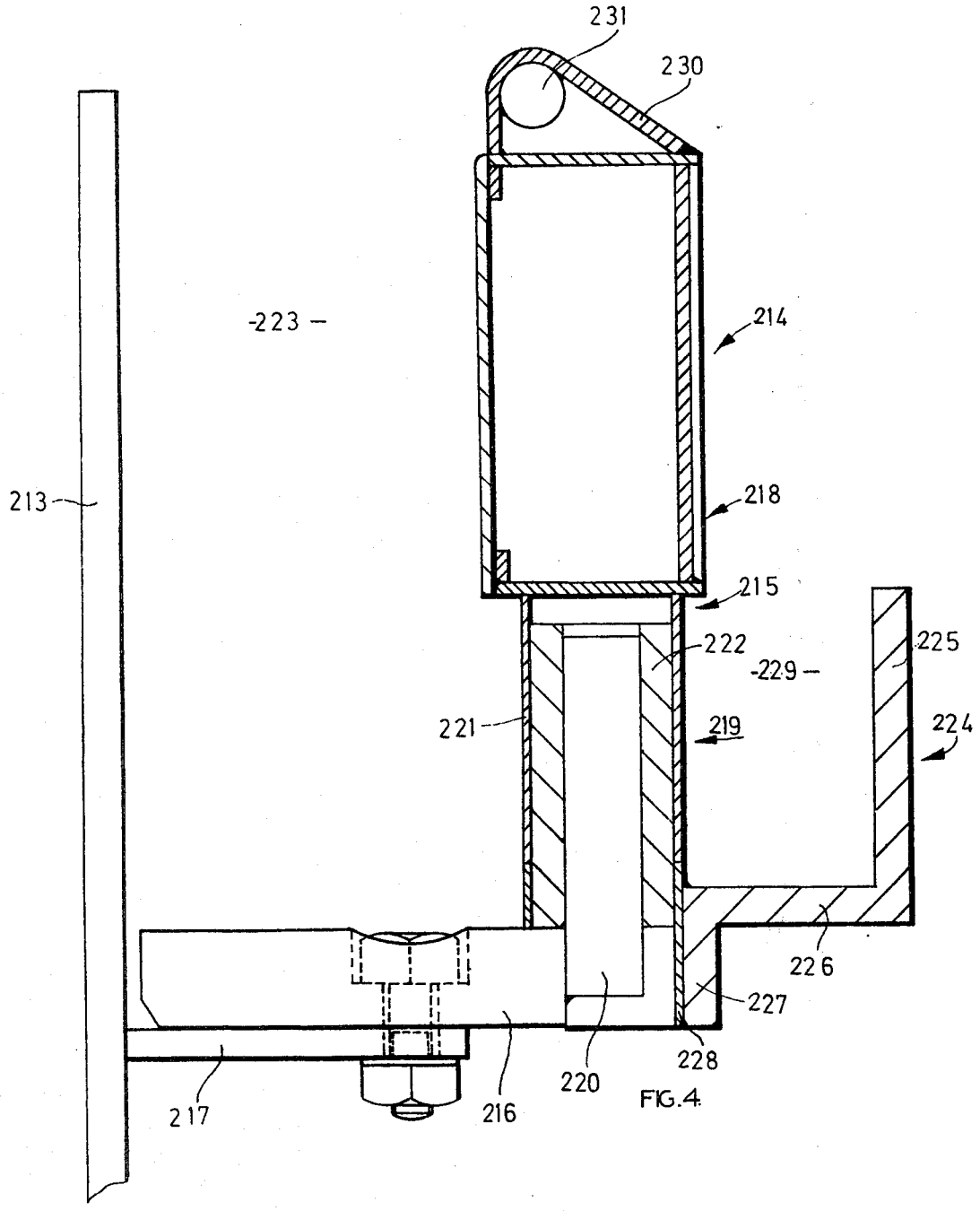
FIG. 4 is a view of the fence structure shown in FIG. 3 in end elevation and partly in vertical cross-section, showing one of the chambers thereof, the control units having been omitted for the sake of simplicity.

The second embodiment of this invention is a conveyor assembly comprising conveyor 210 which may be installed to lie adjacent to and extend along the face of a mine working such as the long wall coal mine working comprising laterally spaced guide rails 211 connected by a deck plate 212, (see FIGS. 3 to 5).

The conveyor is of the scraper type in which a number of transversely extending scraper bars (not shown) span the deck plate and move longitudinally thereof by means of driving chains to which the ends of the scraper bars are connected. The guide rails 211 also form a trackway along which travels a mining machine (not shown) for extracting coal from the face and delivering it onto the deck plate.

To contain the coal thus extracted from the conveyor and prevent it being discharged to the outer or goaf side of the conveyor the latter incorporates an upstanding goaf or spill plate 213.

As with the first embodiment, the mining machine is serviced by movable cables one set of ends of which are connected to the mining machine and are henced required to travel therewith along the conveyor while the other set of ends is connected to sources of electrical and/or hydraulic power and are hence normally stationary.

These cables lie in a loop extending lengthwise of the conveyor and for accommodating and postionally controlling this loop of movable cable there is provided at the outer side of the goaf or spill plate 213 a fence structure 214 comprising a plurality of longitudinally spaced upright post elements 215 connected to each other by horizontal longitudinally extending rail elements 216.

The post elements 215 are spaced laterally from the goaf or spill plate 124 by means of base elements or brackets 216 which are releasably secured by bolts to a laterally projecting flange 217 adjacent to the lower edge of the goaf or spill plate and which may itself be detachably secured thereto in any suitable manner.

Some or all of the post elements 215 incorporate chambers 218 for accommodating control units of the kind specified.

The construction of each post element and chamber incorporated therein and the arrangement of the control and/or indicator devices collectively forming the control unit is seen in more detail in FIG. 4.

As in the first embodiment the fence structure 214 is constructed so as to be yieldable to both longitudinally and laterally applied forces. Thus, each post element 215 comprises a lower portion 219 having a central core 220 formed of a length of rigid metal stock, either rod or tube, which is secured as by welding to the outer end of the base element 216, and surrounding the core element 220 is an outer sleeve element 221 of tubular metal stock such as mild steel which is spaced and supported from the core element by means of an intermediate sleeve element 222 of resilient material such as rubber hose.

The intermediate sleeve element 222 fits tightly on the core element and is in turn embraced tightly by the outer sleeve element. Whilst the latter is therefore maintained in a normally vertical position, it can undergo angular displacement to a limited extend towards and away from the spill plate without the fence structure as a whole becoming damaged, and, upon the application of large longitudinal forces, the elements can be separated and the fence torn down.

The upper portion of the post element as seen in FIG. 4, is constituted by the chamber 218 which is conveniently fabricated from metal plates such as mild steel plate and is of generally rectangular box-like form with its longest dimension arranged vertically. Each such chamber is relatively slim as regards its dimension at right-angles to the plane of the fence structure as a whole so that it either does not project, or projects only to a small extent, as shown towards the interior of the trough 223 afforded between the fence structure 215 and the goaf or spill plate 213. Further, each chamber projects only to a slight extent if at all beyond the lower portion 219 of each post element towards the outer side thereof.

At the outer side of each post element brackets 224 are provided each including an upstanding limb 225, from the lower end of which extends a horizontal limb 226 secured by means of a flange 227 to a subordinate or lower outer sleeve element 228 which tightly embraces the intermediate sleeve element 222.

Each chamber has its lower end situated at a level in the region of the upper end of the bracket 224.

Collectively the brackets 224 afford a channel within which "static" cables as previously mentioned are accommodated. The subordinate or lower sleeve element 228 is cut-away at its inner side to provide flats which abut the base element 216 and therby prevent rotation of the brackets about the axis of the core element, but the brackets are able to undergo angular deflection to a limited extent if engaged by adjacent roof supports by virtue of the yieldable nature of the intermediate sleeve element 222.

It will be noted that due to the small extent which the chamber 218 projects above the channel 229 it does not significantly obstruct insertion and withdrawal of static cable into the channel into the open upper end thereof. Furthermore, because the outer wall of the chamber 218 is inset laterally from the limbs 225 of the brackets, if any engagement occurs between the fence structure and roof supports, it will be the brackets which are so engaged rather than the chambers and the relatively vulnerable control units incorporated in the chambers are thus less prone to damage than would be the case were the outer side of the chamber co-planar with the limbs 225.

At the upper end of each chamber an inverted channel section strap 230 is secured to the top wall of the chamber conveniently by welding and a horizontally projecting length of rod or tubular stock 231 is welded to the interior of the strap to provide laterally projecting spigots which are engaged in sockets afforded by the lengths of horizontal rail elements serving to connect successive post elements at their upper ends.

As with the first embodiment, the rod elements 231 are engaged in the interior of lengths of tubular flexible material such as rubber hose, and the latter, for stiffness, may contain further lengths of rod element at positions intermediate successive post elements but without physical connection to the rod elements 231 otherwise than through the hose.

A typical control unit of the kind specified incorporates a push-button operated signalling switch 232, a lock-out switch 233 having a manually operable control member capable of being moved from an unoperated position to an operated position and locked or retained in the latter and an indicator lamp 234. These devices are mounted within the chamber in superposed relation thereby allowing the chamber to be kept relatively slim as regards its horizontal dimension in the plane of fence. The minimisation of this dimension is of less importance than the minimisation of the horizontal dimension of the chamber in a direction at right-angles to the plane of the fence but has some importance as maintaining the housing within a region when it will receive some protection by virtue of the presence of the brackets 224.

To enable the control units to be connected electrically with each other, electrical connector elements 235 are provided on each of the side walls of the chamber adjacent the upper end thereof and immediately below the horizontal rail 216. When a control and/or indicator system is installed lengths of cable equipped with complementary connector elements extend beneath the horizontal rail 216 and the complementary connector elements are engaged with the connector elements 235. The cable and the connector elements thus receive some protection from the rail element 216 by virtue of their positioning beneath this rail element.

Although in this embodiment of the invention, the chambers 218 are incorporated in the post elements 215, it will be understood that it would be within the scope of the invention for the fence structure 214 to be of other than openwork form. Thus, it could be fabricated from plates and at least at intervals along the length of the fence structure would be of hollow form to provide the requisite chambers for the accommodation of control units of the kind specified.

I claim:

1. In a mining conveyor assembly comprising:

a conveyor which in the use of the assembly extends alongside a mine face, an elongate wall connected to and upstanding from the conveyor, the wall being so comprised and being of such materials that the wall has the characteristic that it is relatively unyielding under externally applied forces, and a fence structure secured in space relation to the wall to provide a trough defined between the wall and the fence structure, the improvement comprising:

the fence structure comprising a plurality of longitudinally-spaced upright elements which are so comprised and of such materials that they have the characteristic that they are yieldable to externally applied forces in a direction laterally of the fence structure;

at least some of the upright elements being provided with a control chamber adapted to contain and enclose a control unit for controlling the conveyor and a respective control unit mounted in and enclosed by each such control chamber for controlling the conveyor and for transmitting a signal to a control station of the conveyor and means accessible from the exterior of said chamber for operating the control unit mounted therein.

2. In the mining conveyor assembly according to claim 1, the improvement further comprising the upright elements having the capability of moving angularly in upright planes with respect to the wall, whereby the upright elements are resiliently deformable under longitudinally applied forces.

3. The mining conveyor assembly according to claim 1, wherein the fence structure comprises a plurality of longitudinally-extending elements connected to and extending between the upright elements.

4. In the mining conveyor assembly according to claim 3, the improvement further comprising the upright and longitudinally-extending elements of the fence structure being secured together in a manner such that they will separate under large longitudinally applied forces.

5. The mining conveyor assembly according to claim 3, the improvement further comprising each chamber being provided, adjacent to its upper end and beneath an uppermost longitudinally extending element of the fence structure, with laterally presented electrical connector elements adapted for releasable connection with complementary connector elements provided at the ends of lengths of cable extending between adjacent chambers beneath the uppermost longitudinally extending element.

6. In the mining conveyor assembly according to claim 1, the improvement further comprising:

the trough being provided for the reception of flexible cables attached to a cutting machine associated with the conveyor assembly, the side of the fence structure remote from the trough being provided with a plurality of longitudinally-spaced brackets which provide a channel for the reception of further cables, the chambers being of sufficiently slim dimensions at right angles to the plane of the fence structure as to present no significant obstruction to entry of cables through the trough and channel to upper ends thereof.

7. In the mining conveyor assembly according to claim 1, the improvement further comprising each of the control units including a plurality of control devices, and the control devices being mounted in the respective chamber one above the other.

* * * * *